US009405214B2

(12) United States Patent
Ogiso et al.

(10) Patent No.: US 9,405,214 B2
(45) Date of Patent: Aug. 2, 2016

(54) IMAGE FORMING APPARATUS FOR DETERMINING A TARGET BIAS VOLTAGE VALUE

(71) Applicant: Brother Kogyo Kabushiki Kaisha, Nagoya-shi, Aichi-ken (JP)

(72) Inventors: Marika Ogiso, Nagoya (JP); Osamu Takahashi, Nagoya (JP); Yasuhiro Shimamura, Nagoya (JP); Tetsuya Okano, Anjo (JP); Yoshifumi Kajikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/582,276

(22) Filed: Dec. 24, 2014

(65) Prior Publication Data

US 2015/0185654 A1 Jul. 2, 2015

(30) Foreign Application Priority Data

Dec. 27, 2013 (JP) ..... 2013-272230

(51) Int. Cl.
*G03G 15/00* (2006.01)
*G03G 15/06* (2006.01)

(52) U.S. Cl.
CPC ..... *G03G 15/065* (2013.01); *G03G 15/5058* (2013.01)

(58) Field of Classification Search
CPC ..... G03G 15/065; G03G 15/5058
USPC ..... 399/24, 49
See application file for complete search history.

(56) References Cited

U.S. PATENT DOCUMENTS

2008/0025738 A1* 1/2008 Ahn ..... G03G 15/0855 399/27

FOREIGN PATENT DOCUMENTS

| | | | |
|---|---|---|---|
| JP | H05289459 | A | 11/1993 |
| JP | H08320600 | A | 12/1996 |
| JP | 2013-178359 | A | 9/2013 |

* cited by examiner

*Primary Examiner* — Quana M Grainger
(74) *Attorney, Agent, or Firm* — Banner & Witcoff, Ltd.

(57) ABSTRACT

There is provided an image forming apparatus including: a forming section having an image holding member and an developing portion, and configured to apply a developing bias voltage to the developing portion to develop an electrostatic latent image on the image holding member; a sensor configured to detect a mark formed by the forming section; a storage; and a controller configured to perform: forming first and second marks, obtaining the densities of the first and second marks, obtaining a slope, and determining a target bias voltage value, and storing the target bias voltage value in the storage.

21 Claims, 10 Drawing Sheets

IMAGE FORMING APPARATUS FOR DETERMINING A TARGET BIAS VOLTAGE VALUE

CROSS REFERENCE TO RELATED APPLICATION

The present application claims priority from Japanese Patent Application No. 2013-272230 filed on Dec. 27, 2013 the disclosure of which is incorporated herein by reference in its entirety.

BACKGROUND OF THE INVENTION

1. Field of the Invention

The present invention relates to a technique for determining a developing bias voltage to be applied to a developing portion when developing an electrostatic latent image.

2. Description of the Related Art

In an image forming apparatus adopting the electro-photographic system, a developing bias voltage is applied to a developing portion so as to develop an electrostatic latent image on an image holding member, thereby forming a toner image. Here, a target bias voltage value of the developing bias voltage for forming a toner image having a target density or a target concentration is not constant at all times, and can vary or fluctuate depending on, for example, any degradation of the toner or the image holding member, etc.

In view of such a situation, there is a conventional image forming apparatus provided with a function for adjusting the bias voltage. This image forming apparatus forms a mark on an intermediate transfer belt, and uses an optical sensor to detect the density or concentration of the mark. Then, the image forming apparatus determines a target bias voltage value based on a predetermined correlation between the density and the bias voltage value of the developing bias voltage. Note that this correlation can be expressed by using a slope in a graph wherein one axis represents the density of the mark and the other axis represents the bias voltage value. Accordingly, the slope is adopted as a parameter indicating the above correlation.

However, due to the degradation of the toner or image holding member, etc., the slope itself varies in some cases. In the conventional image forming apparatus, however, the variation in the above-described slope is not considered, and thus more improvement is desired in the determination of target bias voltage value.

SUMMARY

The present teaching discloses a technique capable of determining a target bias voltage value, while suppressing any influence from the variation in the slope defined by the bias voltage value and the density (slope of the correlation between the bias voltage value and the density). Note that in the following explanation, this slope of the correlation between the density and the bias voltage value is simply referred to as the "slope" as appropriate.

According to an aspect of the present teaching, there is provided an image forming apparatus including: a forming section having an image holding member and an developing portion, and configured to apply a developing bias voltage to the developing portion to develop an electrostatic latent image on the image holding member so as to form a toner image of a toner;

a sensor configured to detect a mark formed as the toner image by the forming section;

a storage; and a controller, wherein the controller is configured to perform:

forming the first mark by applying a developing bias voltage of a first test bias voltage value to the developing portion and developing an electrostatic latent image on the image holding member;

forming the second mark by applying a developing bias voltage of a second test bias voltage value to the developing portion and developing the electrostatic latent image on the image holding member;

obtaining a density of the first mark and a density of the second mark based on a signal from the sensor;

obtaining a slope based on both an amount of change in the first test bias voltage value and the second test bias voltage value and an amount of change in the density of the first mark and the density of the second mark;

determinating a target bias voltage value corresponding to a target density based on the slope, and at least one of a first set and a second set, wherein the first set includes the first test bias voltage value and the density of the first mark, the second set includes the second test bias voltage value and the density of the second mark; and storing the target bias voltage value in the storage.

The variation in the slope defined by the bias voltage value and the density can be grasped by the slopes defined by a plurality of mutually different bias voltage values and the densities of a plurality of marks each of which is formed with a developing bias voltage having one of the plurality of bias voltage values. Accordingly, the image forming apparatus is capable of determining the target bias voltage value based on the slope defined by the amount of change in the first test bias voltage value and the amount of change in the density of the first mark and the slope defined by the amount of change in the second test bias voltage value and the amount of change in the density of the second mark, at least one density among the densities of the first and second marks, and the test bias voltage value corresponding to the at least one density. With this, it is possible to determine the target bias voltage value while suppressing any influence from the variation or change in the slope defined by the bias voltage value and the density.

Note that the present teaching can be realized in a variety of aspects including an image forming apparatus, a method for determining developing bias voltage, a computer program for realizing the method or the function of the image forming apparatus, a non-volatile and computer-readable medium storing the computer program, etc.

According to the present teaching described in the present specification, the target bias voltage value can be determined, while suppressing any influence from the variation or change in the slope defined by the bias voltage value and the density.

DESCRIPTION OF THE PREFERRED EMBODIMENTS

Figure 1:
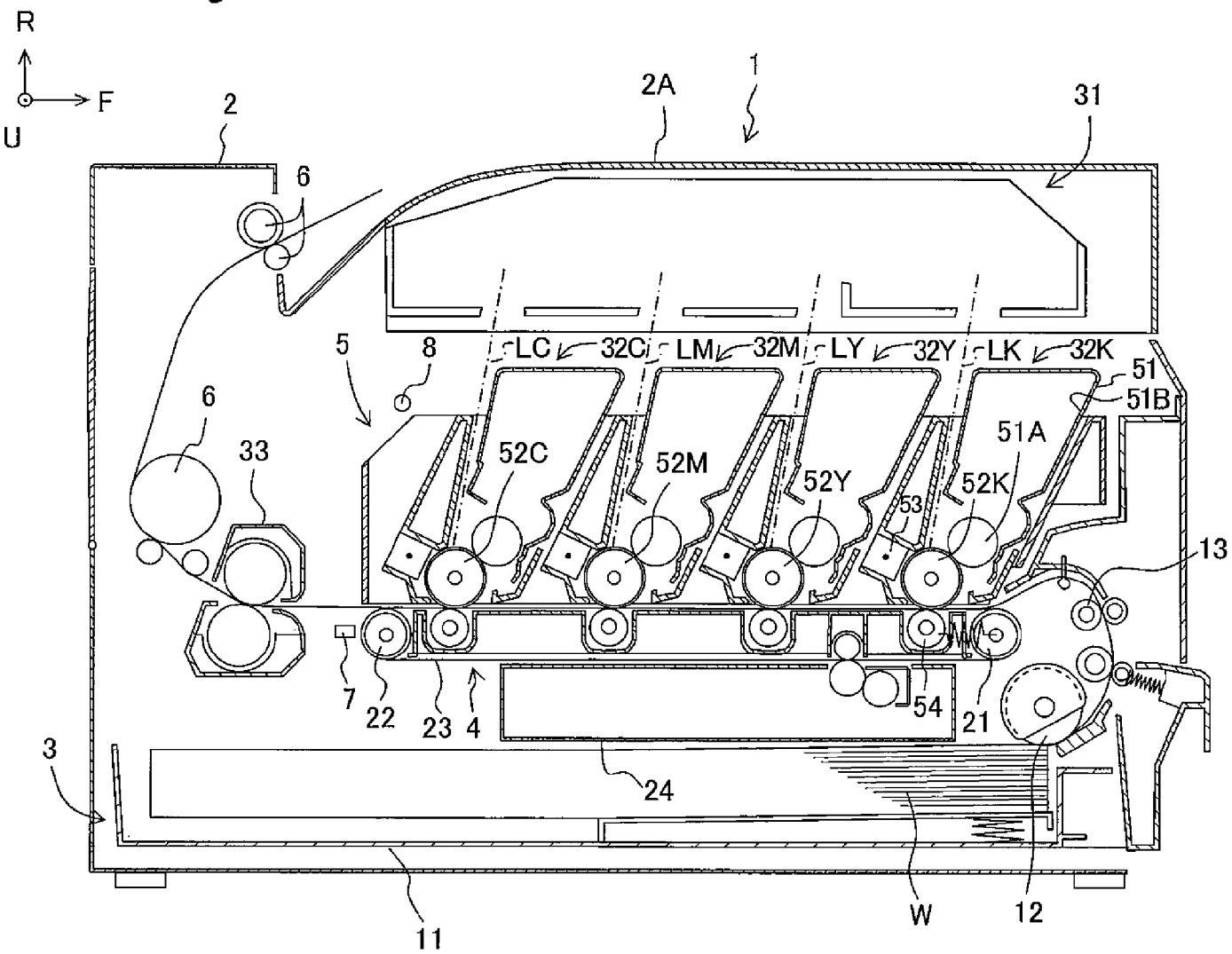
FIG. 1 is a schematic view depicting the mechanical configuration of a printer according to an embodiment.

A printer 1 as an embodiment of the present teaching will be explained with reference to FIGS. 1 to 9. The printer 1 is a tandem-type color laser printer adopting the direct transfer system which forms an image, etc. by using, for example, four colors (black, yellow, magenta and cyan). The printer 1 is an example of the image forming apparatus. Note that in the following explanation, the right side on the sheet surface of FIG. 1 is a front side F of the printer 1, the back side of the sheet surface of FIG. 1 is a right side R of the printer 1, and the upper side on the sheet surface of FIG. 1 is an upper side U of the printer 1. Further, in a case that the respective components, terms, etc. of the printer 1 are to be distinguished by color, a reference numeral relating to a component of a certain color is added, at the end of the reference numeral, with a suffix indicating the color such as "K" (black), "Y" (yellow), "M" (magenta) and "C" (cyan). In FIG. 1, reference numerals for any similar or same components among the respective colors are omitted, as appropriate.

As depicted in FIG. 1, the printer 1 is provided with a body case 2, a sheet supply section 3, a belt unit 4, an image forming section 5, and a discharge roller 6. The sheet supply section 3 has a supply tray 11, a feed-out roller 12, and a resist roller 13. The supply tray 11 is provided on a bottom portion of the body case 2, and is capable of placing a plurality of sheets W thereon. The feed-out roller 12 feeds out the sheets W inside the supply tray 11 one by one to the resist roller 13, and the resist roller 13 transports each of the sheets W onto the belt unit 4.

The belt unit 4 has a configuration wherein a ring-shaped belt 23 is wound around and stretched between a support roller 21 and a drive roller 22. The belt 23 of the belt unit 4 is circularly moved counterclockwise in FIG. 1, and a sheet W electrostatically attracted to the surface of the belt 23 is transported to a fixing portion 33 provided on the rear side with respect to the belt unit 4. A transfer roller 54 is provided inside the belt 23. Note that a cleaner 24 which collects a toner, paper powder (paper dust), etc. adhering on the surface of the belt 23 is provided at a position below the belt unit 4.

The image forming section 5 is an example of the forming section, and is provided with a scanner portion 31, process portions 32K, 32Y, 32M and 32C, the fixing portion 33, etc. The scanner portion 31 irradiates laser beams LK, LY, LM and LC, each of which is based on image data of one of the four colors that are black, yellow, magenta and cyan, onto surfaces of photoconductive or photosensitive drums 52K, 52Y, 52M and 52C corresponding to the four colors, respectively, to thereby performing exposure. The process portion 32K corresponding to the black color has a developing portion 51, a photoconductive drum 52K, a charging portion 53, and a transfer roller 54. The developing portion 51 has a developing roller 51A and a toner accommodating portion 51B, and applies a developing bias voltage from a bias voltage applying section 79 depicted in FIG. 3 to the developing roller 51A so as to develop an electrostatic latent image on the photoconductive drum 52, thereby forming a toner image. The photoconductive drum 52 is an example of the image holding member.

The surface of the photoconductive drum 52K is charged by the charging portion 53, and a portion of the charged surface is exposed by being scanned with the laser beam LK irradiated by the scanner portion 31, thereby forming the electrostatic latent image. Then, a black toner is supplied to the electrostatic latent image by the developing roller 51A provided on the developing portion 51, thereby forming a black toner image on the photoconductive drum 52K.

The toner image held on the photoconductive drum 52K is transferred, between the photoconductive drum 52K and the transfer roller 54K, onto the belt 23 or a sheet W on the belt 23. Each of the process portions 32Y, 32M and 32C corresponding to the yellow, magenta and cyan colors, respectively, has a similar configuration to that of the process portion 32K corresponding to the black color except for the toner color, and any explanation on the specific configuration of the process portions 32Y, 32M and 32C will be omitted.

The sheet W to which toner images of the respective colors are transferred in this manner is then transferred to the fixing portion 33. The fixing portion 33 thermally fixes the tonner images, transferred on the sheet W, to the surface of the sheet W. The sheet W passing through the fixing portion 33 is transported upward by the discharge roller 6 and is discharged onto the discharge tray 2A.

Figure 2:
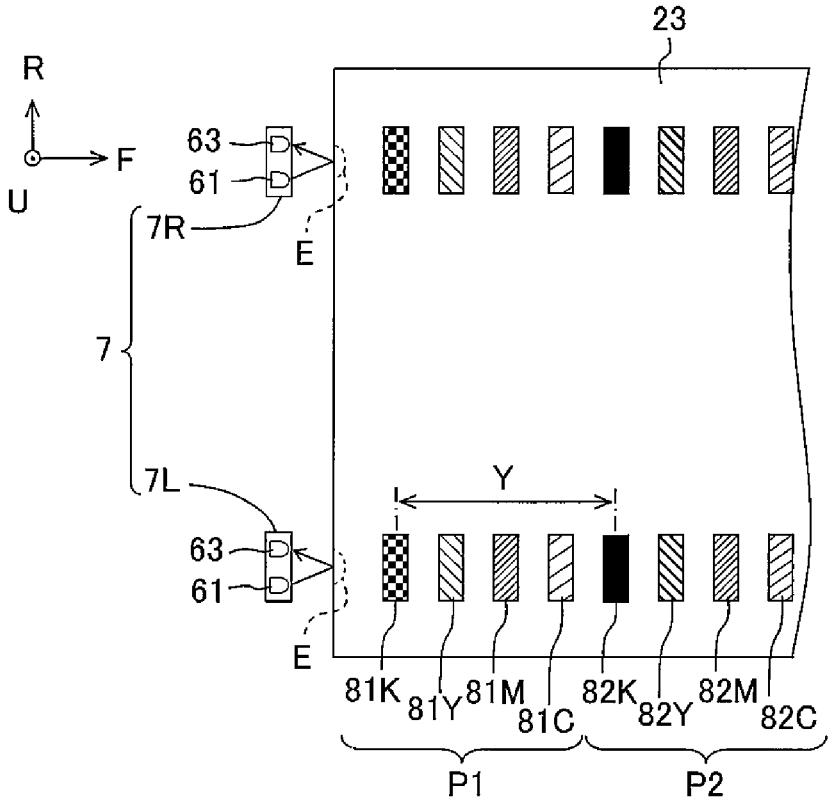
FIG. 2 is a view depicting an example of the arrangement of a mark sensor and an example of marks.

The printer 1 is further provided with a mark sensor 7 and a temperature sensor 8. The mark sensor 7 is an example of the sensor; as depicted in FIG. 2, the mark sensor 7 is constructed of a sensor 7R arranged on the right side in the width direction of the belt 23, i.e. the left/right direction in FIG. 2, and a sensor 7L arranged on the left side of the belt 23. Each of the sensors 7R and 7L is a catoptric sensor having a light-emitting body 61 and a light-receiving body 63, as depicted in FIG. 2. The light-emitting body 61 has, for example, a light-emitting element such as an LED, etc., and irradiates light (light beam) onto a detection area E on the surface of the belt 23.

The light-receiving body 63 has, for example, a light-receiving element such as a photo transistor, etc., and receives the light from the belt 23. Further, the mark sensor 7 outputs a light-receiving signal SG1 corresponding to a light-receiving amount, of the light receiving body 63, that is different depending on the density of the mark 81 and the density of the mark 82 inside the detection area E. The temperature sensor 8 is arranged in the vicinity of the process portion 32 (32K, 32Y, 32M, 32C), and outputs a temperature signal SG2 corresponding to the ambient temperature.

Figure 3:
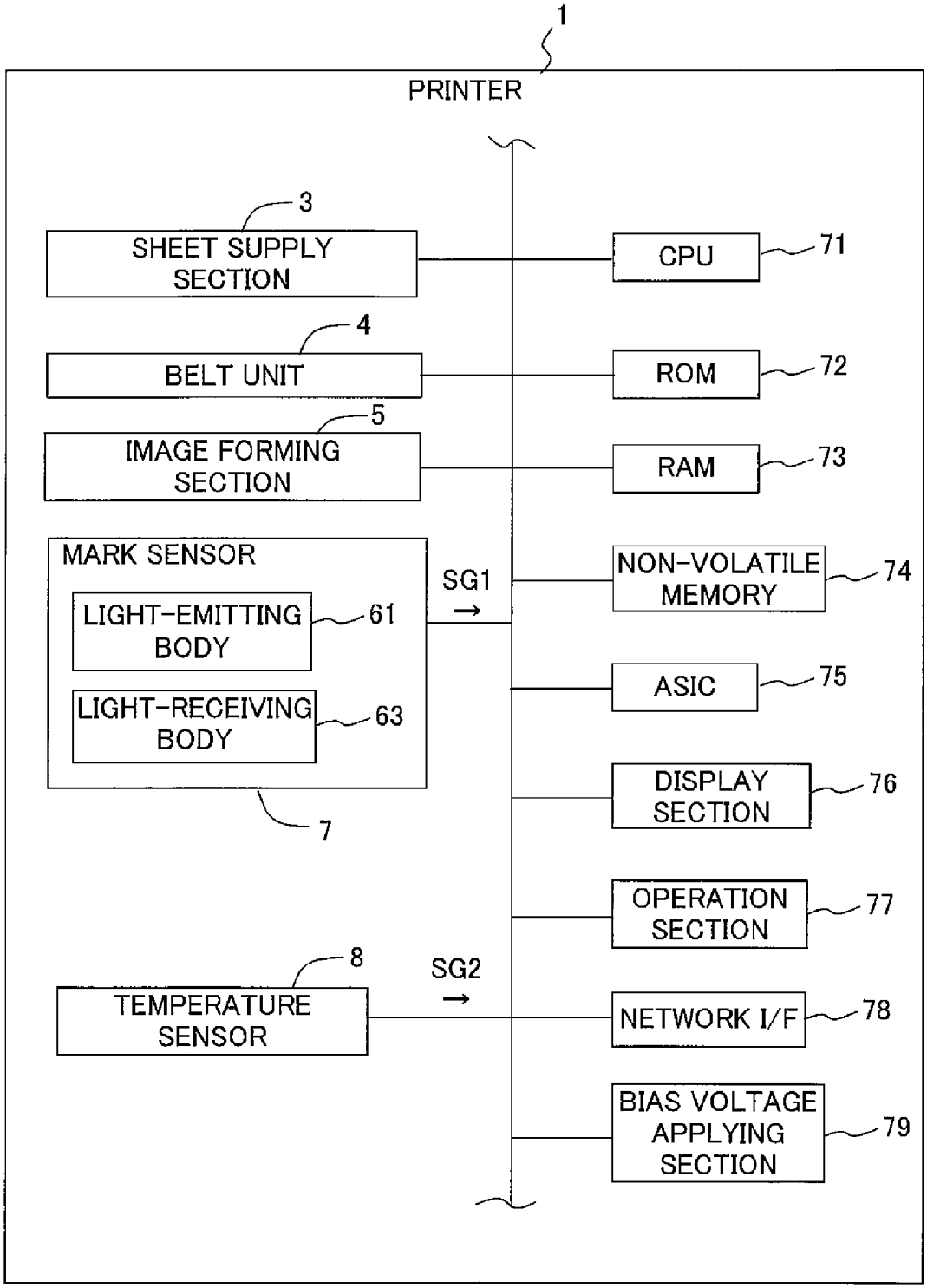
FIG. 3 is a block diagram depicting the electrical configuration of the printer.

As depicted in FIG. 3, the printer 1 has a central processing unit 71 (hereinafter referred to as "CPU 71"), a ROM 72, a RAM 73, a non-volatile memory 74, an Application Specific Integrated Circuit 75 (hereinafter referred to as "ASIC 75"), a display section 76, an operation section 77, a Network interface 78, a bias voltage applying section 79, in addition to the sheet supply section 3, the belt unit 4, the image forming section 5, the mark sensor 7, etc., as described above.

The ROM 72 stores a variety of kinds of programs including, for example, a program for executing a bias voltage control processing (to be described later), a program for controlling the operations of the respective components or parts, such as the image forming section 5, etc., and the like. The RAM 73 is utilized as a work area, a temporary storage area for data, etc. in a case that the CPU 71 executes the variety of kinds of programs. As the non-volatile memory 74, it is allowable to use any rewritable memory such as a NVRAM (Non-Volatile RAM), a flash memory, a HDD (Hard Disk Drive), an EEPROM (Electrically Erasable Programmable Read-Only Memory), etc.

The CPU 71 is an example of the controller. The CPU 71 controls the respective components or parts of the printer 1 in accordance with programs read from the ROM 72. The display section 76 has a liquid crystal display, a display lamp, etc., and is capable of displaying a variety of kinds of setting screens, a state of operation of the printer 1, etc. The operation section 77 is an example of the receiving portion, has a plurality of buttons, and is capable of receiving a variety of kinds of input instructions by a user. The network interface 78 is an interface for communication with an unillustrated external apparatus or device by a radio or cable communication system. The bias voltage applying section 79 applies a developing bias voltage to the developing roller(s) 51A of the developing portion 51. Further, the bias voltage applying section 79 is controllable by the CPU 71 to change the bias voltage value of the developing bias voltage.

In the following, the content or detail of the control executed by the CPU 71 will be explained with reference to FIGS. 4 to 9. In a state that the printer 1 is switched on, the CPU 71 executes a bias voltage control processing depicted in FIGS. 4A and 4B periodically in a repeated manner. At first, the CPU 71 judges whether or not an execution condition for executing adjustment of the bias voltage (bias voltage adjustment) is satisfied, based on a change in a state of the printer 1 since a point of time when the bias voltage adjustment has been executed previously (last time) (S1). The processing executed in S1 is an example of the execution judgment. This bias voltage adjustment is an example of the formation of the first and second marks and an example of the detection of densities of the first and second marks, and is a processing for adjusting the bias voltage value of the developing bias voltage based on the densities of the marks 81, 82 formed on the belt 23 (as will be described later on), for the purpose of suppressing any lowering in image quality due to the change in the state of the printer 1.

The change in the state of the printer 1 includes, for example, the change in the state of the apparatus (printer 1) itself such as any degradation of the toner, any degradation of the photoconductive drum 52 and/or the belt 23 (to be described later on), etc., and the change in environment such as any change in the temperature and any change in the humidity, etc. The execution condition is a condition for executing the bias voltage adjustment before any lowering in the image quality occurs due to the change in the state of the printer 1.

Examples of the execution condition include such a situation that a number of printed sheets W reaches a predetermined number since the bias voltage adjustment has been executed last time, a situation that the duration of time during which the printer 1 is switched on reaches a predetermined duration of time since a point of time when the bias voltage adjustment has been executed last time, a situation that the difference in temperature and/or the difference in humidity are/is not less than the predetermined value(s) since the bias voltage adjustment has been executed last time, and the like.

In a case that the CPU 71 judges that the execution condition is satisfied (S1: YES), the CPU 71 executes a bias voltage difference adjustment processing depicted in FIGS. 5A and 5B (step S2; hereinafter referred to as "S2" simply) and a test bias voltage determination processing depicted in FIG. 6 (S5) and proceeds to S6. On the other hand, in a case that the CPU 71 judges that the execution condition is not satisfied (S1: NO), the CPU 71 judges whether or not the operation section 77 has received an execution instruction for executing the bias voltage adjustment processing (S3); in a case that the CPU 71 judges that the operation section 77 has received the execution condition (S3: YES), the CPU 71 executes a processing in S4 and the processing in S5, and proceeds to S6.

The CPU 71 determines a low test bias voltage value VL and a high test bias voltage value VH by the processing in S5. These low and high test bias voltage values VL and VH are bias voltage values of the developing bias voltage which are applied by the bias voltage applying section 79 to the developing portion 51 during formation of the marks 81 and 82 (to be described later on). The low test bias voltage value VL is an example of the first test bias voltage value, and the high test bias voltage value VH is an example of the second test bias voltage value, and is a value higher than the low test bias voltage value VL. For the convenience of explanation, the contents of the processing in each of S2 to S5 will be explained later.

After the CPU 71 determines the low test bias voltage value VL and the high test bias voltage value VH in S5, the CPU 71 obtains a slope coefficient F of the density with respect to the developing bias voltage, based on the low and high test bias voltage values VL and VH (S6 to S10). The slope coefficient F is an example of the slope indicating the correlation between the density and the developing bias voltage, and may be a slope coefficient of the developing bias voltage with respect to the density.

At first, the CPU 71 causes or controls the image forming section 5 to operate such that a developing bias voltage having the low test bias voltage value VL is applied to the developing portion 51, while the belt 23 is being driven to rotate, so as to form a first density detection pattern P1 on the belt 23 (S6). Note that the first density detection pattern P1 is formed on the belt 23 at positions on the both end portions of the belt 23, namely at positions each passing through one of the respective detection areas E of the sensors 7R and 7L. The first density detection pattern P1 is a group of marks provided for detecting density and composed of a first mark 81K of the black color, a first mark 81Y of the yellow color, a first mark 81M of the magenta color, and a first mark 81C of the cyan color which are arranged in the sub scanning direction; each of the first mark 81K, first mark 81Y, first mark 81M and first mark 81C may be provided as a single mark or a plurality of marks.

Next, the CPU 71 causes the image forming section 5 to operate such that a developing bias voltage having the high test bias voltage value VH is applied to the developing portion 51, while the belt 23 is being driven to rotate, so that a second density detection pattern P2 is formed on the belt 23 (S7). Note that the second density detection pattern P2 is also formed on the belt 23 at positions passing through the respective detection areas E of the sensors 7R and 7L. The second density detection pattern P2 is a group of marks provided for detecting density and composed of a second mark 82K of the black color, a second mark 82Y of the yellow color, a second mark 82M of the magenta color and a second mark 82C of the cyan color which are arranged in the sub scanning direction; each of the second mark 82K, second mark 82Y, second mark 82M and second mark 82C may be provided as a single mark or a plurality of marks. The processing in S6 and the processing in S7 are an example of the formation of the first and second marks, and CPU 71 may execute the processing of S6 after executing the processing of S7.

Here, if the image forming section 5 forms an electrostatic latent image and a toner image of the first mark 81 with respect to each of the respective colors and an electrostatic latent image and a toner image of the second mark 82 with respect to each of the respective colors on the photoconductive drum 52 (for example, the photoconductive drum 52K) at mutually overlapping positions in the circumferential direction of the photoconductive drum 52, then the following problem might arise. Namely, a phenomenon of so-called "fogging" may occur due to the formation of the second mark 82 during a period of time in which the remaining tonner, used in the formation of the first mark 81, has not been completely removed. In such a case, there is a fear that the detection precision of the density of the mark 82 might be lowered in a detection processing in S8 which is to be executed next.

In view of such a possibility, the image forming section 5 forms the electrostatic latent images and toner images of the first and second marks 81, 82 with respect to each of the colors in the processing in S6 and the processing in S7, respectively, such that the electrostatic latent images and toner images of the first marks 81 with respect to each of the colors are formed on the photoconductive drum 52 (for example, the photoconductive drum 52K) at mutually different positions from those of the electrostatic latent images and toner images of the second marks 82 with respect to each of the colors, in the circumferential direction of the photoconductive drum 52. For example, a distance "Y" between the first and second marks 81 and 82 as depicted in FIG. 2 is longer than a length corresponding to one round of the photoconductive drum 52 and shorter than a length corresponding to two rounds of the photoconductive drum 52.

Note that the distance Y may be shorter than the length corresponding to one round of the photoconductive drum 52. With this, it is possible to suppress any lowering in the detection precision of the density of each of the first and second marks 81 and 82 which would be otherwise caused due to the formation of the first and second marks 81, 82 at a same position on the photoconductive drum 52 (for example, the photoconductive drum 52K).

After starting the formation of the first and second marks 81 and 82, the CPU 71 detects the densities of the first and second marks 81 and 82 with respect to each of the colors, based on the light-receiving signal SG1 from the mark sensor 7 (S8). The processing in S8 is an example of the detection of the densities of the first and second marks. Note that the processing in S8 may be started at either one of the following timings, namely, during executing the processing of S5 and the processing of S6 or after completing execution of the processing of S5 and the processing of S6. In the following, a detected density of the first mark 81 is referred to as "first detected density D1", and a detected density of the second mark 82 is referred to as "second detected density D2". Note that in a case that a plurality of pieces of the first mark 81 of a same color are included in the first density detection pattern P1, the CPU 71 may determine, with respect to each of the colors, an average value of the detected densities of these plurality of first marks 81, as the density of the same color. This is similarly applicable to the second density detection pattern P2.

Next, the CPU 71 judges whether or not the detected densities are within a normal range, with respect to each of the colors (S9). The term "normal range" means a presumed range of the density of a certain image in a case that a developing bias voltage within a predetermined bias voltage variable range is applied to the developing portion 51 and the certain image is formed normally. For example, if the formed image is fuzzy due to any shortage of tonner inside the developing portion 51, etc., and/or the belt 23 is dirtied or degraded, the densities of the marks 81 and 82 exhibit any abnormal values in some cases. In a case that such density error has occurred, the CPU 71 judges that the detected densities are not within the normal range (S9: NO), and CPU 71 ends the bias voltage control processing. With this, it is possible to suppress or prevent such a situation that a target bias voltage value VT is determined based on a detected density having any density error occurred therein. Note that in a case that the CPU 71 judges that the detected densities are not within the normal range (S9: NO), the CPU 71 may proceeds to S15 which will be described later on.

In a case that the CPU 71 judges in S9 that the detected densities are each within the normal range (S9: YES), the CPU 71 calculates the slope coefficient F of the density with respect to the developing bias voltage based on the low and high test bias voltage values VL and VH and the first and second detected densities D1 and D2, for each of the colors, with Formula 1 as follows (see S10; and FIGS. 7 and 8). The slope coefficient F is a value indicating the correlation between the density and the developing bias voltage corresponding to a present extent of degradation of the toner, etc.

$$\text{Slope coefficient } F=(D2-D1)/(VH-VL) \qquad \text{[Formula 1]}$$

In S11, the CPU 71 judges whether or not the slope coefficient F calculated in S10 is within a predetermined range. The processing in S11 is an example of the slope judgment. The term "predetermined range" means a range of the slope which is presumed in advance by, for example, an experiment, etc. For example, in such a case that the positivity or negativity of the value of the slope coefficient F exhibit any abnormal value, such as being different from the presumed positivity or negativity of the value, etc., the CPU 71 judges that the slope coefficient F is not within the predetermined range (S11: NO), and in accordance with this judgment, CPU 71 does not determine the target bias voltage value VT based on the current slope coefficient F calculated this time in S10.

Specifically, the CPU 71 does not utilize the current slope coefficient F calculated this time, but reads out, for example, an existing slope coefficient F0 stored in the non-volatile memory 74 (S15), and proceeds to S13*a*. The term "existing slope coefficient F0" means, for example, an initial value of the slope coefficient, a slope coefficient calculated in S10 last time or before the last time. With this, it is possible to suppress such a situation that the target bias voltage value VT is determined with a low precision which would otherwise be caused due to the slope coefficient F that is not within the predetermined range.

In a case that the CPU 71 judges in S11 that the slope coefficient F is within the normal range (S11: YES), the CPU 11 judges, according to this judgment made in S11, whether or not a target density DT is included within a test bias voltage range (S12). The processing in S12 is an example of the condition judgment; an example of the density condition is that the target density DT is included in the test bias voltage range. The target density DT is a density for adjusting the bias voltage (bias voltage adjusting density) which is previously determined, is preferably for example such a density with which any density unevenness and/or fogging are/is unlikely to occur, and is exemplified by a density with 50% gradation. The test bias voltage range is a range between the first detected density D1 and the second detected density D2, and is an example of the density range.

Figure 7:
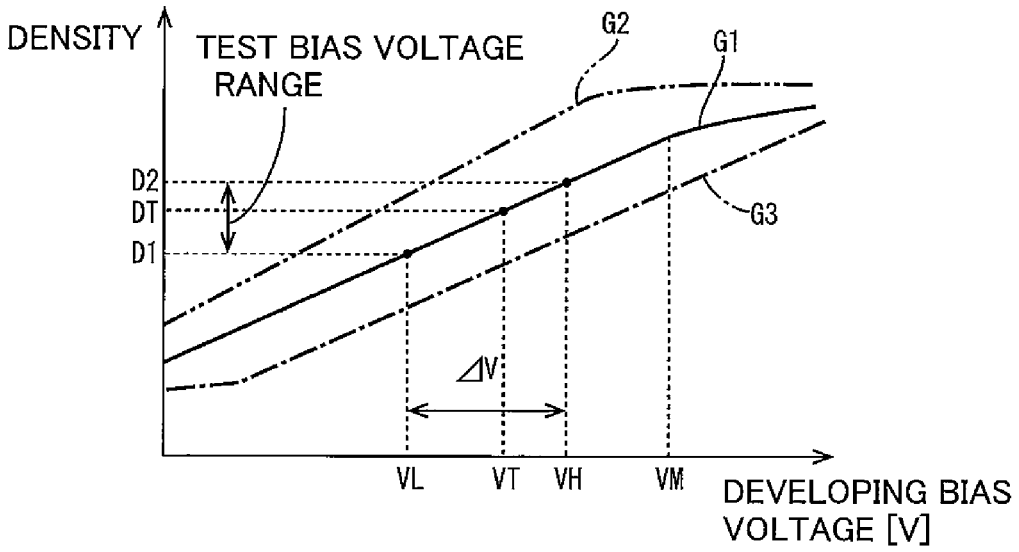
FIG. 7 is graph 1 depicting the change characteristics of developing bias voltage and density.

For example, in such a case in FIG. 7 that a change characteristic line between the current developing bias voltage and the density is line G1, the target density D1 is located between the first detected density D1 and the second detected density D2. In such a case, the CPU 71 judges that the target density DT is included in the test bias voltage range (S12: YES), and the CPU 71 executes, according to the judgment made in S12, the determination processing for determining the target bias voltage value based on the slope coefficient F calculated this time in S10 (S13*a*). With this, it is possible to suppress any lowering of the determination precision of the target bias voltage value VT, as compared with a case that the determination processing of S13*a* is executed regardless of the result of judgment made in S12. After the determination processing, the CPU 71 executes the storage processing for storing the bias voltage value in the storage such as the RAM 73 or the non-volatile memory 74 (S13*b*).

The determination processing of the target bias voltage value is a processing for determining the target bias voltage value VT corresponding to the target density DT, based on the slope coefficient F, at least one density of the first detected density D1 and the second detected density D2, and the test bias voltage value corresponding to the at least one density. The target bias voltage value VT is a bias voltage value of the developing bias voltage which is necessary for causing the image forming section 5 to form an image having the target density DT.

Specifically, the CPU 71 calculates and determines the target bias voltage value VT by Formula 2 as follows and stores the target bias voltage value VT in the non-volatile memory 74.

$$VT=VX-[(DX-DT)/F] \quad \text{[Formula 2]}$$

In Formula 2, "DX" is the first detected density D1 or the second detected density D2 detected in S8. In the following description, "DX" is a density which is one of the first detected density D1 and the second detected density D2, and which is closer to the target density DT. Further, in Formula 2, "VX" is a test bias voltage value which is one of the low test bias voltage value VL and the high test bias voltage value VH, and which corresponds to the density DX closer to the target density DT. With this, the difference between the detected density DX and the target density DT is small, as compared with a case using a density far from the target density DT; and it is possible to suppress the determination error of the target bias voltage value VT to be small, by the extent of smallness of the above difference.

Figure 8:
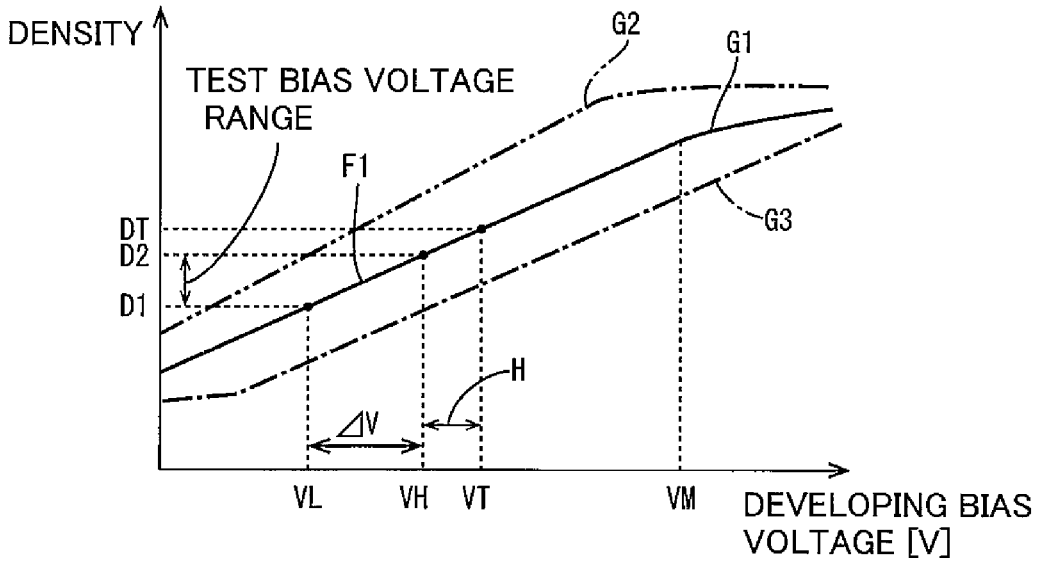
FIG. 8 is graph 2 depicting the change characteristics of developing bias voltage and density.

On the other hand, in FIG. 8, the target density DT is not present between the first detected density D1 and the second detected density D2. In such a case, the slope of the change characteristic line G1 is different at a portion in the vicinity of the target density DT and a portion between the first and second detection densities D1 and D2, leading to such a possibility that the target bias voltage value VT could not be precisely determined with a slope coefficient F1 indicated in FIG. 8. In such a situation, the CPU 71 judges that the target density DT is not included in the test bias voltage range (S12: NO); and the CPU 71 judges, in accordance with the judgment made in S12, whether or not a correction difference H is not more than a reference difference (S14).

The term "correction difference H" means the difference between the target bias voltage value VT obtained by Formula 2 described above and one of the low and high test bias voltage values VL and VH which is the closest to the target bias voltage value VT. The reference difference is a correction difference of which determination error does not substantially affect the image quality, even if the target bias voltage value VT is determined by utilizing the slope coefficient F1; the reference difference can be determined by, for example, a result of experiment, etc. Note that the correction difference H may be a difference between the target density DT and the detected density DX closest to the target density DT.

In a case that the CPU 71 judges that the correction difference H is not more than the reference difference (S14: YES), the CPU 71 proceeds to S13*a* in accordance with the judgment made in S14. On the other hand, in a case that the CPU 71 does not judge that the correction difference H is not more than the reference difference (S14: NO), the CPU 71 proceeds to S15 in accordance with the judgment made in S14. Namely, in a case that the target density DT is not included in the test bias voltage range, the CPU 71 does not determine the target bias voltage value VT based on the slope coefficient F calculated in S10. With this, it is possible to suppress (prevent) the target bias voltage value VT from being determined with a low precision due to the situation that the target density DT is not included in the test bias voltage range.

In a case that the CPU 71 judges that the execution condition is satisfied (S1: YES), the CPU 71 executes, in accordance with the judgment made in S1, the bias voltage difference adjustment processing depicted in FIGS. 5A and 5B for each of the colors (S2). The bias voltage difference adjustment processing is a processing for adjusting a bias voltage difference ΔV (=VH−VL) between the low test bias voltage value VL and the high test bias voltage value VH with respect to a value of the bias voltage adjustment executed last time, depending on the change in the state of the printer 1 since a point of time when the bias voltage adjustment has been executed last time or therebefore.

Here, if the bias voltage difference ΔV is made to be same with respect to all the developing portions 51 of all the colors, there is a possibility that the slope coefficient F might be precisely identified for a toner of certain color but might not be precisely identified for a toner of another color, due to the difference in characteristic among the toners of different colors, etc. In view of such a possibility, the CPU 71 makes the bias voltage difference ΔV be different between developing sections 51 for at least two of the colors. Specifically, a toner image of the yellow color has small difference in density with respect to a same bias voltage difference, as compared with a toner image of the black color. Accordingly, the bias voltage difference ΔV for the developing portion 51 for the yellow color is set to have a value greater than that for the developing portion 51 for the black color. Note that the bias voltage difference ΔV for each of the cyan and magenta colors is set to have a value between the bias voltage difference ΔV for the black color and the bias voltage difference ΔV for the yellow color. By doing so, it is possible to determine the target bias voltage value for each of the colors, while suppressing any effect due to the difference in characteristics among the toner of different colors, etc.

Further, in such a case that the change in the state of the printer 1 is relatively great since the point of time when the bias voltage adjustment has been executed last time, the slope of the density with respect to the developing bias voltage is changed greatly since the point of time when the bias voltage adjustment has been executed last time, and there is a high possibility that the target density DT is not included in the test bias voltage range. On the other hand, in a case that the above-described change in the state is relatively small, then the slope of the density with respect to the developing bias voltage is not changed much since the point of time when the bias voltage adjustment has been executed last time, and there is a low possibility that the target density DT is not included in the test bias voltage range. Accordingly, the CPU 71 detects at first in S21 an amount of change in the temperature since the point of time when the bias voltage adjustment has been executed last time, based on the temperature signal SG2 from the temperature sensor 8, and detects an elapsed time elapsed since the point of time when the bias voltage adjustment has been executed last time. The processing in S21 is an example of the state detection.

Next, the CPU 71 changes the bias voltage difference ΔV depending on the magnitude (extent) of the change in the state of the printer 1 detected in S21. Specifically, the CPU 71 makes the bias voltage difference ΔV be greater as the above-described change in the state is greater (S22 to S26). These processings are an example of the increasing. With this, it is possible to suppress or prevent the target bias voltage value VT from being determined with a low precision due to the situation that the target density DT is not included in the test bias voltage range, as compared with a case that the bias voltage difference ΔV is not changed regardless of the change in the state of the printer 1. Specifically, the CPU 71 judges whether or not the amount of change in the temperature is greater than a reference value (S22); in a case that the CPU 71 judges that the amount of change in the temperature is not greater than the reference amount (S22: NO), the CPU 71 further judges, in accordance with the judgment made in S22, whether or not the elapsed time described above is longer than a reference time (S23).

In a case that the CPU 71 judges that the elapsed time is not longer than the reference time (S23: NO), the CPU 71 sets, in accordance with the judgment made in S23, the current bias voltage difference ΔV to a small value (S24), and proceeds to S27. The small value is a value smaller than a middle value to be described next. Note that in S24, it is allowable that the CPU 71 does not change the current bias voltage difference ΔV from the bias voltage difference ΔV of the last time, or may change the current bias voltage difference ΔV to be smaller than the bias voltage difference ΔV of the last time. In short, in a case that the change in state of the printer 1 is small, the variation or fluctuation of the target bias voltage value VT is also considered to be small. Accordingly, since the CPU 71 sets the current bias voltage difference ΔV to a small value, it is expected that the target bias voltage value VT is set with a high precision, as compared with a case of setting the current bias voltage difference ΔV to a middle value.

In a case that the CPU 71 judges that the elapsed time is longer than the reference time (S23: YES), the CPU 71 sets, according to the judgment made in S23, the current bias voltage difference ΔV to a middle value (S25), and proceeds to S27. The middle value is a default value. In a case that the CPU 71 judges that the amount of change in the temperature is greater than the reference value (S22: YES), the CPU 71 sets, according to the judgment made in S22, the current bias voltage difference ΔV to a large value (S26), and proceeds to S27. The large value is a value greater than the middle value.

Here, even if the extent of degradation of the tonner, the photoconductive drum 25, etc., is same, there is such a case that the slope defined by the bias voltage value and the density is changed and the linearity thereof is lost in an area in which the bias voltage value is relatively great and an area in which the bias voltage value is relatively small, as depicted in FIGS. 7 and 8. For example, there is assumed such a case that the low test bias voltage value VL and the high test bias voltage value VH are determined in the vicinity of an area at which the bias voltage value is great. Then, there is a fear that the low test bias voltage value VL and the high test bias voltage value VH might be determined straddling areas before and after a bias voltage value VM at which the slope of the change characteristic line is changed, and thus the slope coefficient F might not be calculated precisely in S10, which in turn might lead to any lowering in the determination precision of the target bias voltage value VT.

In view of such a situation, the CPU 71 judges whether or not there is a possibility that at least one of the low test bias voltage value VL and the high test bias voltage value VH is determined in the area in which the bias voltage value is great or the area at which the bias voltage value is small (S27, S28). Specifically, at first in S27, the CPU 71 obtains a most recent bias voltage value from, for example, the non-volatile memory 74. The most recent bias voltage value is an example of the value corresponding to the target bias voltage value VT determined last time or therebefore. Specifically, the CPU 71 presumes the progressing degree of the degradation of the toner, etc., by counting the number of rotations of the photoconductive drum 52, etc., the number of formed dots and the elapsed time since a point of time when the target bias voltage value VT has been determined previously (last time), and the CPU 71 stores the presumed progressing degree in the non-volatile memory 74 as appropriate. Then, the CPU 71 decrease the bias voltage value, of the developing bias voltage for forming an image, from the target bias voltage value VT by an amount or extent corresponding to the above-described progressing degree. The most recent bias voltage value is the most recent bias voltage value after the decrease.

Here, as will be described later on, the CPU 71 temporarily determines the low test bias voltage value VL and the high test bias voltage value VH, with the most recent bias voltage value as the reference (see S31 of FIG. 6). Accordingly, by judging whether or not the most recent bias voltage value is closer to the area in which the bias voltage value is great or the area in which the bias voltage value is small, it is possible to judge whether or not there is a possibility that at least one of the low test bias voltage value VL and the high test bias voltage value VH might be determined in the area in which the test bias voltage value is great or in the area in which the test bias voltage value is small.

Specifically, the CPU 71 judges whether or not the most recent bias voltage value is out of an upper/lower limit range (S28). The state that the most recent bias voltage value is greater than the upper limit value means that there is a possibility that at least the high test bias voltage value VH might be determined in the area in which the bias voltage value is great; the state that the most recent bias voltage value is smaller than the lower limit value means that there is a possibility that at least the low test bias voltage value VL might be determined in the area in which the bias voltage value is small. The processing in S28 is an example of the upper limit-judgment and an example of the lower limit-judgment.

In a case that the CPU 71 judges that the most recent bias voltage value is out of the upper/lower limit range (S28: YES), the CPU 71 decreases, in accordance with the judgment made in S28, the bias voltage difference ΔV set in S24 to S26 to a smaller value (S29), ends the bias voltage difference adjustment processing, and proceeds to S5 depicted in FIG. 4A. At this time, the CPU 71 may decrease the bias voltage difference ΔV to a value smaller than that in the bias voltage adjustment processing executed last time or therebefore. The processing in S29 is an example of the decreasing. With this, it is possible to suppress or prevent the target bias voltage value VT from being determined with a low precision due to such a situation that the low test bias voltage value VL and the high test bias voltage value VH are set straddling areas before and after the bias voltage value VM at which the slope is changed, as compare with a case that the bias voltage difference ΔV is not decreased. On the other hand, in a case that the CPU 71 does not judge that the most recent bias voltage value is out of the upper/lower limit range (S28: NO), the CPU 71 does not execute, in accordance with the judgment made in S28, the processing in S29, ends the bias voltage difference adjustment processing, and proceeds to S5 depicted in FIG. 4A.

Figure 4A:
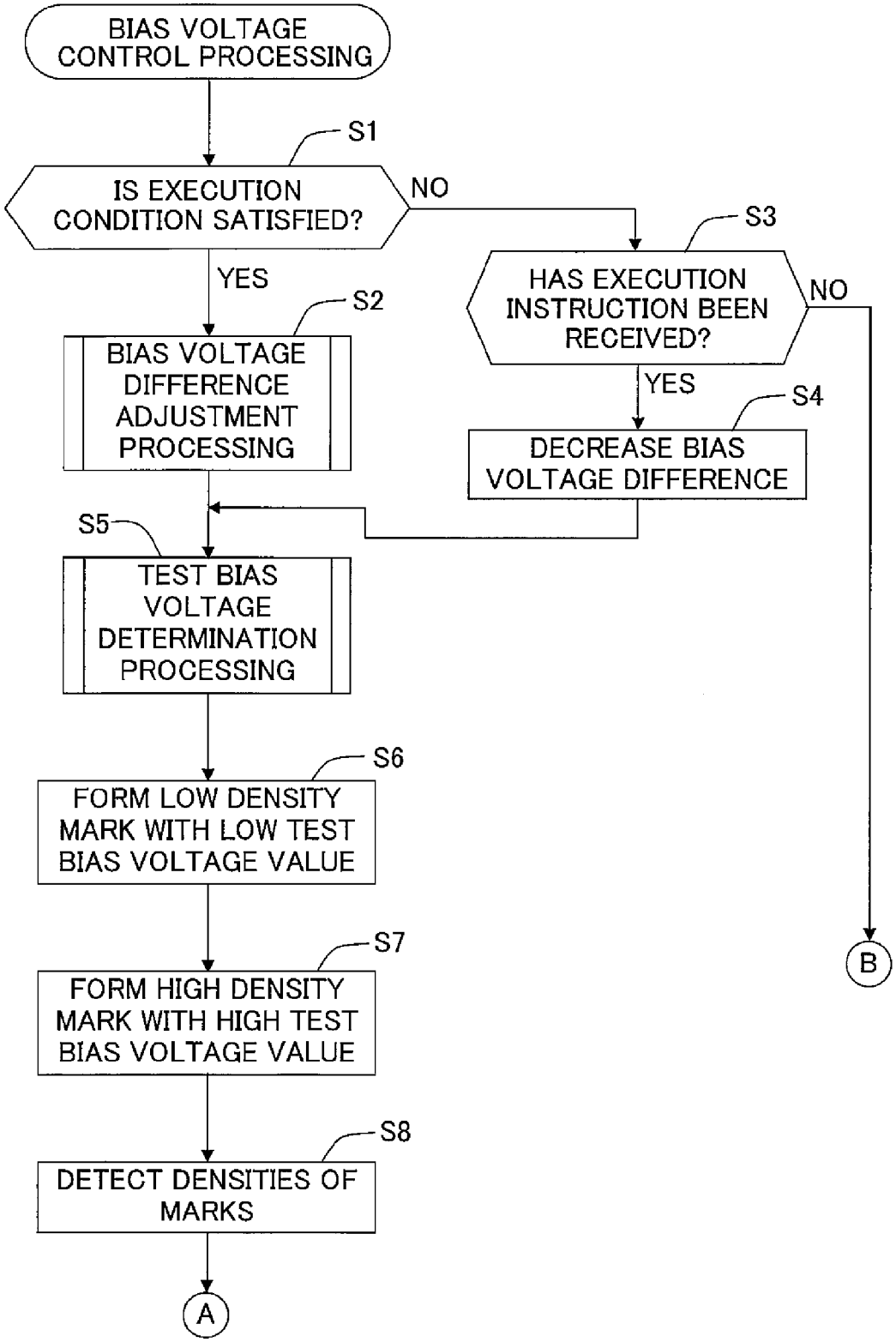
FIGS. 4A and 4B are flow charts depicting a bias voltage control processing.

In a case that, in S1 and S3 depicted in FIG. 4A, the CPU 71 judges that the execution condition is not satisfied (S1: NO) and that the operation section 77 has received an execution instruction for the bias voltage adjustment (S3: YES), the CPU 71 decreases, in accordance with these judgments made in S1 and S3, the bias voltage difference ΔV of the bias voltage adjustment executed last time or therebefore to a smaller value (S4), and proceeds to S5. The processing in S4 is an example of the decreasing. Here, in a case that the execution instruction for bias voltage adjustment has been given before the execution condition is satisfied, there is a high possibility that the user demands that the target bias voltage value VT is to be determined with a high precision. Accordingly, by executing the processing of S4 in such a case, it is expected that the target bias voltage value VT is determined with a high precision, thereby meeting the user's demand, as compared with a case that the bias voltage difference ΔV is not changed even when the execution instruction is received. Note that in a case that the CPU 71 judges that the execution condition is not satisfied (S1: NO) and that the operation section 77 has not received the execution direction for bias voltage adjustment (S3: NO), the CPU 71 ends the bias voltage control processing in accordance with the judgments made in S1 and S3.

Figure 6:
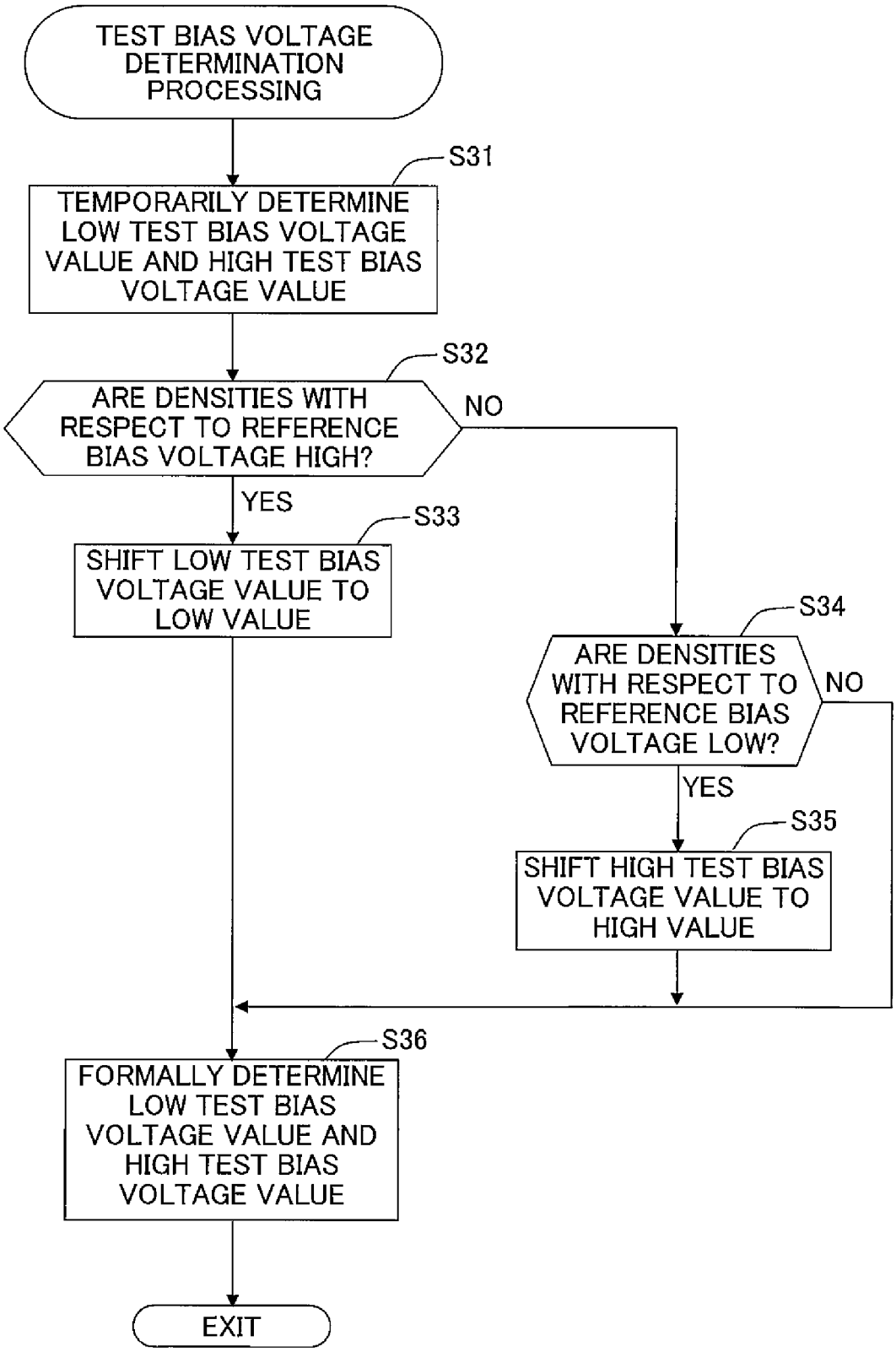
FIG. 6 is a flow chart depicting a test bias voltage determination processing.

After executing the processing in S2 or S4, the CPU 71 executes in S5 the test bias voltage determination processing depicted in FIG. 6. The test bias voltage determination processing is a processing for temporarily determining the low test bias voltage value VL and the high test bias voltage value VH based on the most recent bias voltage value and the bias voltage difference ΔV adjusted in the processing in S2 or S4. Specifically, the CPU 71 temporarily determines the low test bias voltage value VL and the high test bias voltage value VH such that the most recent bias voltage value is a center value and the difference between the high and low test bias voltage values VL and VH is the bias voltage difference ΔV (S31). In such a manner, the current low and high test bias voltage values VL and VH are temporarily determined with the most recent bias voltage value as the reference. With this, the current high and low test bias voltage values VL and VH are temporarily determined so as to follow the most recent bias voltage value. Accordingly, it is possible to suppress the target bias voltage value VT from being determined with a low precision due to such a situation that the target density DT is out of the test bias voltage range, as compared with a case that the high and low test bias voltage values VL and VH are temporarily determined regardless of the most recent bias voltage value.

Further, the CPU 71 temporarily determines the low and high test bias voltage values VL and VH within a bias voltage variable range. The bias voltage variable range is a bias voltage range within which the image forming section 5 is capable of forming a toner image normally. With this, it is possible to suppress the target bias voltage value VT from being determined with a low precision due to a situation that any one of the low and high test bias voltage values VL and VH is set to be out of the bias voltage variable range.

Next, the CPU 71 presumes the highness or lowness of the densities of the first and second marks with respect to the reference bias voltage value, based on the change in the state of the printer 1 since the point of time when the bias voltage adjustment has been executed last time or therebefore (S32). The processing in S32 is an example of the presumption. The reference bias voltage value is an arbitrary bias voltage value, and the densities of the first and second marks with respect to the reference bias voltage value is a density of an image formed by applying the developing bias voltage having the reference bias voltage value to the developing portion 51. The CPU 71 is capable of detecting the change in the state of the printer 1 by utilizing the result of detection in S21 (see FIG. 5A) as described above.

Figure 9:
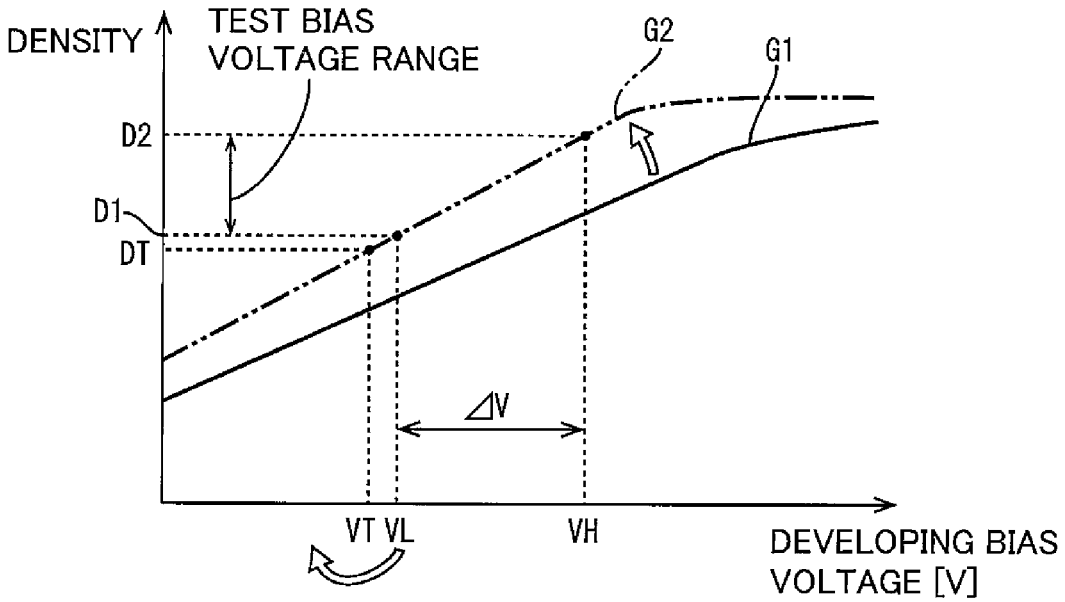
FIG. 9 is graph 3 depicting the change characteristics of developing bias voltage and density.

For example, in a case that the printer 1 is degraded and/or that the temperature and/or the humidity are/is increased, the change characteristic line between the developing bias voltage and the density tends to shift to an area in which the density is high, namely, the density with respect to the reference bias voltage value tends to be high. Here, there is assumed such a case that in FIGS. 7 and 8 the change characteristic line at a point of time when the bias voltage adjustment was executed last time is G1, that the low and high test bias voltage values VL and VH are determined to be the values depicted in FIGS. 7 and 8, and that the change characteristic line is varied or changed from G1 to G2 at point of time when the current bias voltage adjustment is executed. In such an assumed case, if the low and high test bias voltage values VL and VH are made to the values same as those in the bias voltage adjustment executed last time, there is a high possibility that the target density DT is not included in the test bias voltage range, as depicted in FIG. 9.

Accordingly, in a case that the CPU 71 judges that the density with respect to the reference bias voltage value is higher than that of the last time (S32: YES), the CPU 71 makes, in accordance with the judgment made in S32, the low test bias voltage value temporarily determined in S31 be shifted to the side of a lower voltage than that of the last time (S33), formally determines the low and high test bias voltage values VL and VH after the shifting as the currently determined low and high test bias voltage values VL and VH (S36), ends the test bias voltage determination processing, and proceeds to S6 in FIG. 4A. The processing in S33 is an example of the shifting. With this, it is possible to suppress the target density DT from not being included in the test bias voltage range due to a situation that the density with respect to the reference bias voltage value becomes high.

On the other hand, for example, in a case that the temperature and/or the humidity in the printer 1 are/is decreased, the change characteristic line between the developing bias voltage and the density tends to shift to an area in which the density is low, namely, the density with respect to the reference bias voltage value tends to be high. Here, there is assumed such a case that in FIGS. 7 and 8 the change characteristic line at a point of time when the bias voltage adjustment was executed last time is G1, that the low and high test bias voltage values VL and VH are determined to be the values depicted in FIGS. 7 and 8, and that the change characteristic line is varied or changed from G1 to G3 at point of time when the current bias voltage adjustment is executed. In such an assumed case, if the low and high test bias voltage values VL and VH are made to the values same as those in the bias voltage adjustment executed last time, there is a high possibility that the target density DT is not included in the test bias voltage range.

Accordingly, in a case that the CPU 71 judges that the density with respect to the reference bias voltage value is lower than that of the last time (S32: NO and S34: YES), the CPU 71 makes, in accordance with the judgments made in S32 and S34, the high test bias voltage value VH temporarily determined in S31 be shifted to the side of a higher voltage than that of the last time (S35), formally determines the low and high test bias voltage values VL and VH after the shifting as the currently determined low and high test bias voltage values VL and VH (S36), ends the test bias voltage determination processing, and proceeds to S6 in FIG. 4A. The processing in S35 is an example of the shifting. With this, it is possible to suppress the target density DT from not being included in the test bias voltage range due to a situation that the density with respect to the reference bias voltage value become low.

In a case that the CPU 71 judges that the density with respect to the reference bias voltage value is substantially same as that of the last time (S32: NO and S34: NO), the CPU 71 proceeds to S36 without executing the shift processing, in accordance with the judgments made in S32 and S34.

According to this embodiment, the variation in the slope defined by the bias voltage value and the density can be grasped by the slopes defined by the plurality of mutually different bias voltage values and the densities of the plurality of marks each of which is formed with a developing bias voltage having one of the plurality of bias voltage values. Accordingly, this printer 1 determines the target bias voltage value VT based on the slope coefficient F of the slopes defined by the high and low test bias voltage values VL and VH and the detected densities D1 and D2, respectively, at least one density among the detected densities D1 and D2, and the test bias voltage value corresponding to the at least one density. With this, it is possible to determine the target bias voltage value while suppressing any influence from the variation or change in the slope defined by the bias voltage value and the density.

Further, both of the first and second marks 81 and 82 are formed in the bias voltage control processing. With this, it is possible to suppress the toner consumption amount and to decrease the load for performing the processing, compared with a case of forming other mark(s) in addition to the first and second marks 81 and 82. Furthermore, the CPU 71 executes the bias voltage control processing individually for each of the plurality of developing portions 51. By doing so, even in a case that the characteristic is different among the colors and the extent of degradation are different among the photoconductive drums 52 of the respective toner of different colors and thus the variation or change in the slope defined by the bias voltage value and the density is different among the respective toners of different colors, it is possible to determine the target bias voltage value VT while suppressing any effect due to the above differences.

The technique disclosed in the present specification is not limited to the embodiment as described in the explanation and depicted in the drawings as above, and includes, for example, a variety of modifications of the aspect as described below.

The "image forming apparatus" is not limited to the tandem-type color laser printer adopting the direct transfer system, and may be exemplified by an image forming apparatus adopting another system such as an image forming apparatus adopting the intermediate transfer system, an image forming apparatus adopting the 4-cycle system, etc. Further, the image forming apparatus may include a monochrome-dedicated image forming apparatus, without being limited only to the color image forming apparatus. Furthermore, the image forming apparatus may be an image forming apparatus adopting an electro-photographic system other than the polygon scanning system, such as those adopting the LED system, etc.

The "transporting member" is not limited to the belt 23 configured to transport the sheet W, and may be an intermediate transfer belt, a photoconductive belt, etc.; or may be a rotary body such as a roller. In short, the transport member may be any member configured to transport a coloring agent or colorant formed by the developing portion directly or via the sheet W. The "image holding member" may also be a photoconductive belt, an intermediate transferring member, etc.

Figure 4B:
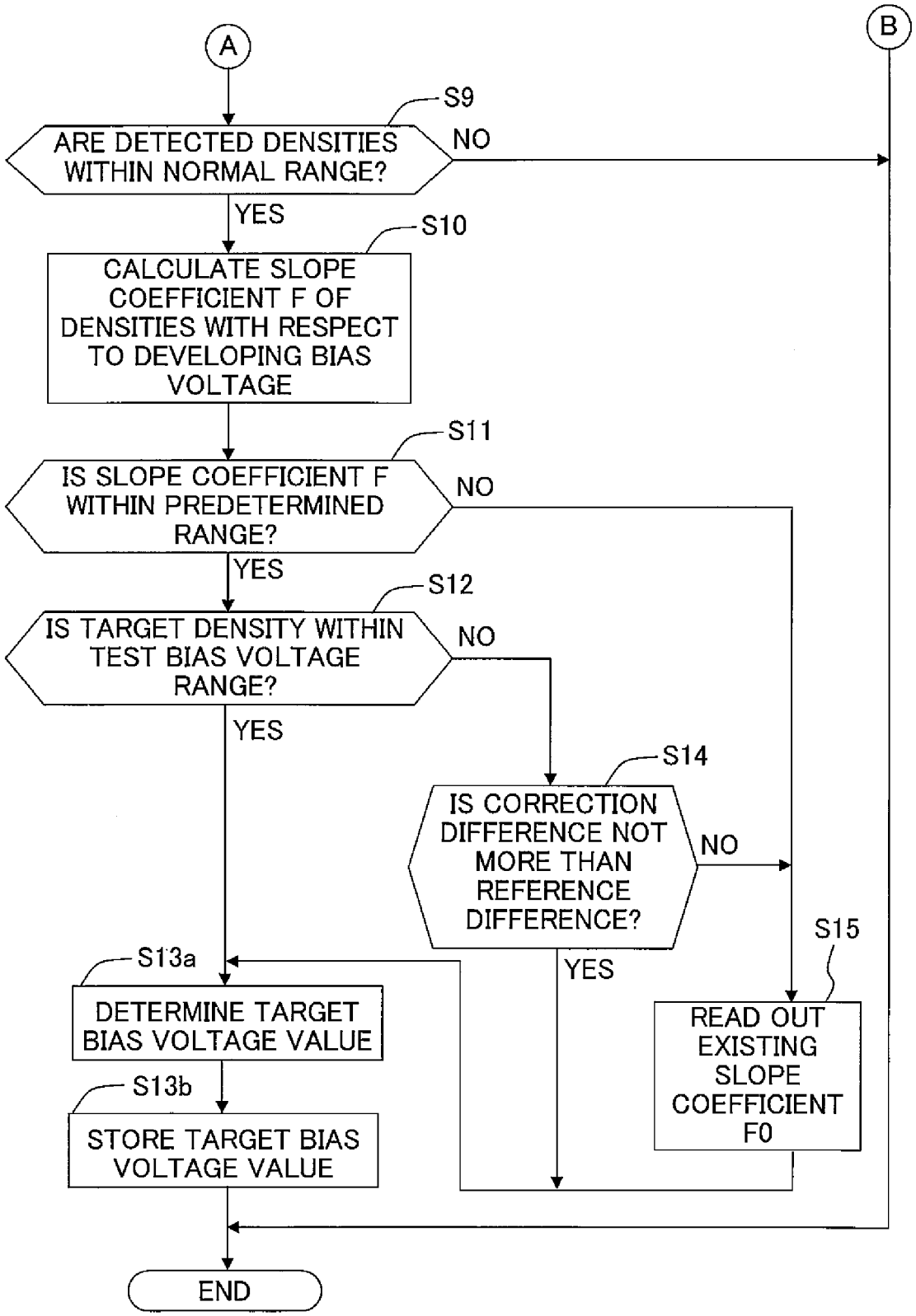

The "controller" has the configuration wherein one CPU 71 executes the respective processings depicted in FIGS. 4A and 4B, etc. The controller, however, is not limited to this, and the controller may have a configuration wherein a plurality of pieces of CPU execute the respective processings depicted in FIGS. 4A and 4B, etc., a configuration wherein only a dedicated hardware circuit such as the ASIC 75 executes the respective processings depicted in FIGS. 4A and 4B, etc., a configuration wherein a CPU and a dedicated hardware circuit execute the respective processings depicted in FIGS. 4A and 4B, etc., and the like.

The "receiving portion" is not limited to the operation section 77 receiving an operation inputted by the user, and may be a communication portion such as the network interface 78 receiving an execution instruction from any external device or apparatus.

In the bias voltage control processing in FIGS. 4A and 4B, in a case that the CPU 71 judges in S1 that the execution condition is satisfied (S1: YES), the CPU 71 may execute the processings in S6 and S7 by utilizing a fixed bias voltage difference ΔV, in accordance with the judgment made in S1, without executing the processings in S2 and S5. Alternatively, it is allowable that the CPU 71 executes only either one of the processing in S2 and the processing in S5. Further, in a case that the CPU 71 judges in S1 that the execution condition is not satisfied (S1: NO), the CPU 71 may end the bias voltage control processing, in accordance with the judgment made in S1, without executing the processing in S3. Furthermore, in a case that the CPU 71 judges in S3 that the execution instruction has been received (S3: YES), the CPU 71 may proceed to S5 in accordance with the judgment made in S3, without executing the processing in S4.

Moreover, it is allowable that the CPU 71 does not execute at least one of the processing in S11 and the processing in S12. Alternatively, in a case that the CPU 71 judges in S12 that the target density DT is not included in the test bias voltage range (S12: NO), the CPU 71 may proceed to S15 in accordance with the judgment made in S12, without executing the processing in S14.

The "execution judgment processing" in S1 depicted in FIGS. 4A and 4B is executed based on the change in the state of the printer 1 since a point of time when the bias voltage adjustment has been performed last time; it is allowable that the "point of time" described herein is not limited to the point of time when the bias voltage adjustment has been executed last time, and includes a point of time when the bias voltage adjustment has been executed before the last time, or a plurality of points of time when the bias voltage adjustments were executed the last time and therebefore, respectively.

The CPU 71 may utilize three or more test bias voltage values in the bias voltage control processing. In such a case, the CPU 71 may adjust the bias voltage difference between the minimum test bias voltage value and the maximum test bias voltage value among the three or more test bias voltage values. Further, the CPU 71 may calculate in S10 the slope coefficient F from approximate lines defined by the three or more test bias voltage values and three or more detected densities corresponding thereto, respectively.

The "density condition" in S12 may include a condition which is different from the condition that the target density DT is included in the test bias voltage range.

In the determination processing in S13*a* depicted in FIG. 4B, the CPU 71 may utilize a plurality of densities including the first detected density D1 and the second detected density D2 to thereby determine the target bias voltage density VT. For example, the CPU 71 may utilize an average density between the first and second detected densities D1 and D2 to thereby determine the target bias voltage value VT.

The judgment condition in S14 depicted in FIG. 4B may include other condition such as that the slope coefficient F is within a presumed range, etc.

Figure 5A:
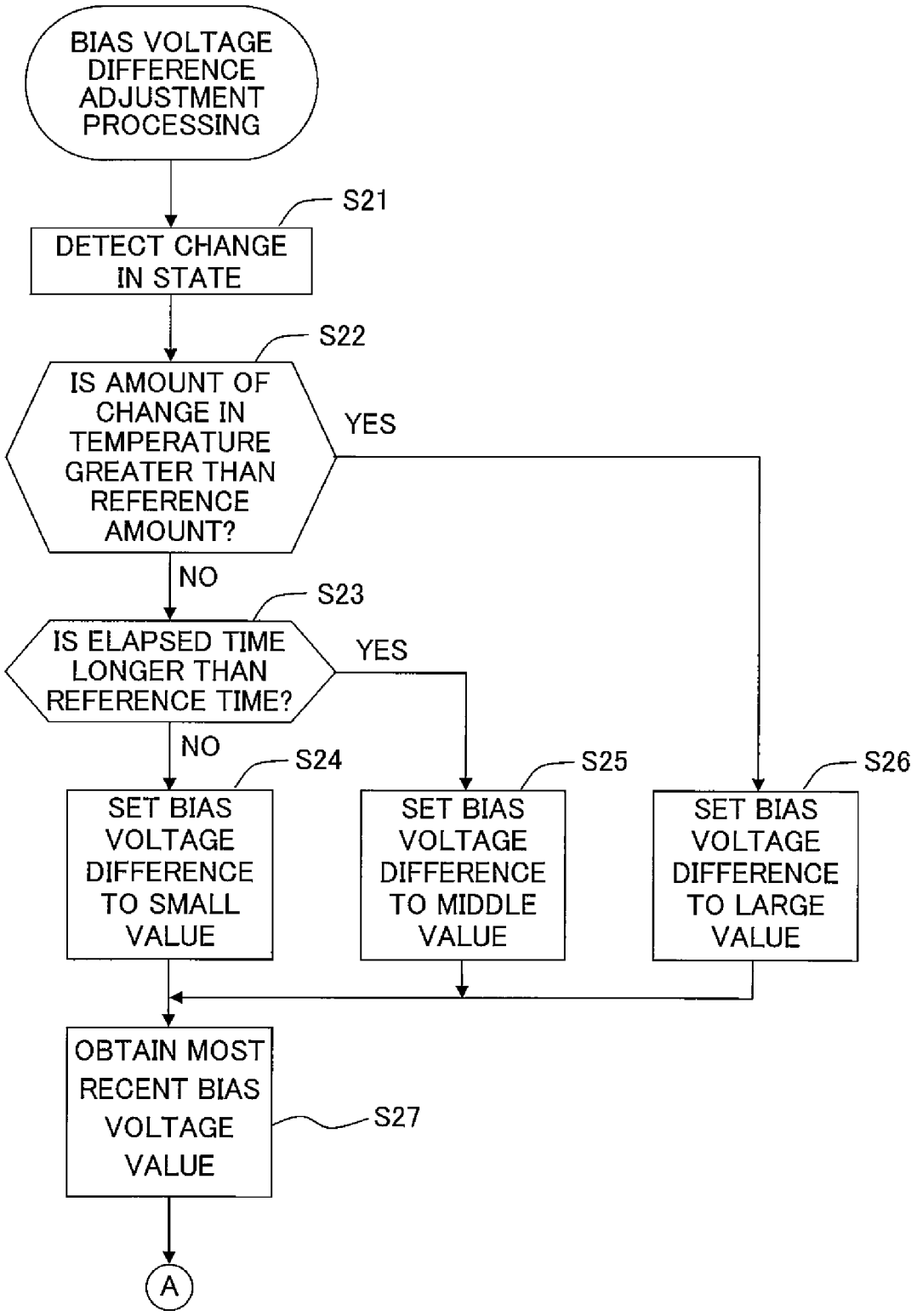
FIGS. 5A and 5B are flow charts depicting a bias voltage difference adjustment processing.

In the bias voltage difference adjustment processing in FIG. 5A, the CPU 71 may execute the processing in S27, without executing the processings in S21 to S26. Alternatively, the CPU 21 may execute only either one of the processings in S22 and S23. Still alternatively, the CPU 71 may end the bias voltage difference adjustment processing after executing the processings in S21 to S26, without executing the processings in S27 to S29.

Figure 5B:
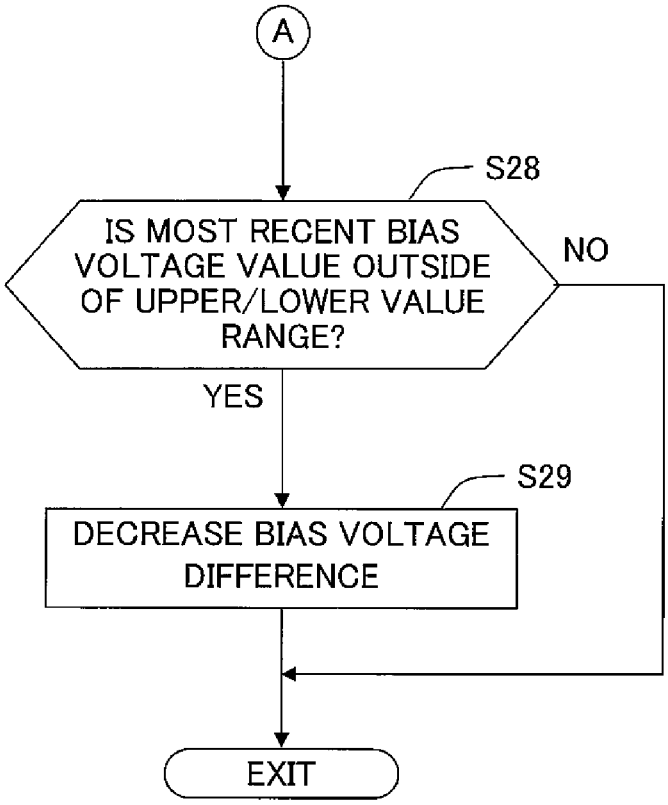

In the bias voltage difference adjustment processing in FIGS. 5A and 5B, the bias voltage difference ΔV may have a value same with respect to all of the colors. Alternatively, the CPU 71 may execute the bias voltage control processing for a certain color among the colors, and may utilize a target bias voltage value VT for the certain color obtained as a result to the processing for the remaining colors.

In the "state detection processing", the CPU 71 may detect an amount of change in the humidity, an amount (extent) of the degradation of the toner and/or the belt 23, the number of rotations of the photoconductive drum 52 and/or the belt 23, etc., since the point of time when the bias voltage adjustment has been executed last time. Further, the bias voltage difference ΔT may be adjusted based on the change in the state of the printer 1 since a point of time when the bias voltage adjustment has been performed last time; it is allowable that the "point of time" described herein is not limited to the point of time when the bias voltage adjustment has been executed last time, and includes a point of time when the bias voltage adjustment has been executed before the last time, or a plurality of points of time when the bias voltage adjustments were executed the last time and therebefore, respectively.

In S28 depicted in FIG. 5B, the CPU 71 may compare the magnitude of the most recent bias voltage value with that of either one of the upper and lower limit values. Further, the CPU 71 may judge whether or not there is a possibility that at least one of the low test bias voltage value VL and the high test bias voltage value VH is determined in the area in which the bias voltage value is great or the area in which the bias voltage value is small, based on whether or not the low test bias voltage value VL and the high test bias voltage value VH at the time of the bias voltage adjustment executed last time or therebefore are included in the upper/lower limit range.

In the test bias voltage determination processing in FIG. 6, the CPU 71 may determine the low test bias voltage value VL and the high test bias voltage value VH, based on the target bias voltage value VT which has been determined last time or therebefore as the reference. Alternatively, it is allowable that the CPU 71 does not execute either one of the processings of S32, S33 and the processings in S34, S35.

In the "presumption processing" in S32 depicted in FIG. 6, the CPU 71 may detect the change in the state of the printer 1 based on, for example, any increase/decrease in the most recent bias voltage value with respect to the target bias voltage value VT determined last time, rather than based on the result of detection of S21 in FIG. 5A.

In the "shift processing" in S33 and the "shift processing" in S35 depicted in FIG. 6, the CPU 71 may shift both of the low test bias voltage value VL and the high test bias voltage value VH, while maintaining the bias voltage difference ΔV which has been adjusted in the bias voltage difference adjustment.

The processing according to the embodiment and the modification thereof can be provided as a non-transitory computer readable medium storing a controlling program executable by a computer of an image recording apparatus, the image recording apparatus provided with the computer includes:

a forming section having an image holding member and an developing portion, and configured to apply a developing bias voltage to the developing portion to develop an electrostatic latent image on the image holding member so as to form a toner image of a toner; and a sensor configured to detect density of a mark formed by the forming section;

the controlling program being configured to cause the controller to execute:

controlling of the forming section to operate so as to form a first mark and a second mark, the forming section forming the first mark by applying a developing bias voltage of a first test bias voltage value to the developing portion so as develop an electrostatic latent image on the image holding member, and the forming section forming the second mark by applying a developing bias voltage of a second test bias voltage value to the developing portion so as develop the electrostatic latent image on the image holding member;

detection of density of the first mark and density of the second mark based on a signal from the sensor; and determination of a target bias voltage value corresponding to a target density based on a slope defined by an amount of change in the first test bias voltage value and an amount of change in the density of the first mark and a slope defined by an amount of change in the second test bias voltage value and an amount of change in the density of the second mark, at least one density of the density of the first mark and the density of the second mark, and a test bias voltage value which is one of the first and second test bias voltage values and which corresponds to the at least one density.

Note that the processings described in the embodiment and the modification thereof may be executed by a single CPU, a plurality of CPUs, hardware such as ASIC, or any combination thereof. Further, the processing described in the embodiment and the modification thereof may be realized by a variety of kinds of aspects, such as a computer-readable recording medium storing a program for executing the processings, a method for executing the processings, etc. The above-described program can be provided as a computer-readable medium such as CD-ROM, DVD, Blu-ray disc, etc., a hard disk installed on a computer such as a server computer, client computer, etc., a memory disk, etc.

Note that each of the programs may be composed of one program module, or may be composed of a plurality of program modules.

What is claimed is:

1. An image forming apparatus comprising:

a forming section having an image holding member and an developing portion, and configured to apply a developing bias voltage to the developing portion to develop an electrostatic latent image on the image holding member so as to form a toner image of a toner;

a sensor configured to detect a mark formed as the toner image by the forming section;

a storage; and a controller, wherein the controller is configured to perform:

forming a first mark by applying a developing bias voltage of a first test bias voltage value to the developing portion and developing an electrostatic latent image on the image holding member;

forming a second mark by applying a developing bias voltage of a second test bias voltage value to the developing portion and developing the electrostatic latent image on the image holding member;

obtaining a density of the first mark and a density of the second mark based on a signal from the sensor;

obtaining a slope based on both an amount of change in the first test bias voltage value and the second test bias voltage value and an amount of change in the density of the first mark and the density of the second mark;

determining a target bias voltage value corresponding to a target density based on the slope, and at least one of a first set and a second set, wherein the first set includes the first test bias voltage value and the density of the first mark, the second set includes the second test bias voltage value and the density of the second mark; and storing the target bias voltage value in the storage, wherein the controller is further configured to perform:

detecting a change in a state of the image forming apparatus since a point of time when the forming of the first and second marks has been previously executed, and increasing of a bias voltage difference between the first and second test bias voltage values to a greater value, as the change in the state of the image forming apparatus is greater.

2. The image forming apparatus according to claim 1, wherein the forming section has a plurality of pieces of the developing portion; and wherein the controller is configured to perform, individually for each of the plurality of developing portions, forming the first and second marks, obtaining the density of the first mark and the density of the second mark, determining the target bias voltage value, and storing the target bias voltage value.

3. The image forming apparatus according to claim 2, wherein in the forming of the first and second marks, the controller makes a bias voltage difference between the first and second test bias voltage values be different with respect to at least two developing portions among the plurality of developing portions.

4. The image forming apparatus according to claim 3, wherein the plurality of pieces include colors includes black color and yellow color; and wherein the bias voltage difference is greater for a yellow developing portion than that for a black developing portion.

5. The image forming apparatus according to claim 1, wherein the controller is configured to perform judging whether or not a density condition is satisfied, the density condition including that the target density is included in a density range between the densities of the first and second marks; and wherein, under a condition that the controller judges that the density condition is satisfied, the controller determines the target bias voltage value based on the slopes in the determination of the target bias voltage value.

6. The image forming apparatus according to claim 1, wherein the controller is configured to execute determination of the first and second test bias voltage values for formation of the first and second marks to be executed this time, with the target bias voltage value previously determined, or a value corresponding to the target bias voltage value previously determined, as a reference.

7. The image forming apparatus according to claim 6, wherein the controller is configured to perform:

judging whether or not the target bias voltage value previously determined, or the value corresponding to the target bias voltage value previously determined, is not less than an upper value; and decreasing a bias voltage difference between the first and second test bias voltage values to a smaller value in response to the judgment in which the controller judges in the upper limit-judgment that the target bias voltage value previously determined, or the value corresponding to the target bias voltage value previously determined, is not less than the upper value, wherein the smaller value is smaller than the bias voltage difference as compared with a case that the controller does not judge that the target bias voltage value previously determined, or the value corresponding to the target bias voltage value previously determined, is not less than the upper value.

8. The image forming apparatus according to claim 6, wherein the controller is configured to perform judging whether or not the target bias voltage value previously determined, or the value corresponding to the target bias voltage value previously determined, is not more than a lower value, wherein decreasing of a bias voltage difference between the first and second test bias voltage values to a smaller value in response to the controller judges in the lower limit-judgment that the target bias voltage value previously determined, or the value corresponding to the target bias voltage value previously determined, is not more than the lower value, and wherein the smaller value is smaller than the bias voltage difference as compared with a case that the controller does not judge that the target bias voltage value previously determined, or the value corresponding to the target bias voltage value previously determined, is not more than the lower value.

9. The image forming apparatus according to claim 1, further comprising a receiving portion;

wherein the controller is configured to perform:

judging whether or not an execution condition based on a change in a state of the image forming apparatus since a point of time when the forming of the first and second marks has been previously executed, wherein the execution condition is that the image forming apparatus executes the forming of the first and second marks is satisfied;

judging whether or not the receiving portion receives an execution instruction in response to the judgment in which the execution condition is not satisfied; and decreasing of a bias voltage difference between the first and second test bias voltage values to a smaller value in response to judge the receiving portion does not receive an execution instruction, wherein the smaller value is smaller than the bias voltage difference that at the point of time when the forming of the first and second marks has been previously executed or before the point of time.

10. An image forming apparatus comprising:

a forming section having an image holding member and an developing portion, and configured to apply a developing bias voltage to the developing portion to develop an electrostatic latent image on the image holding member so as to form a toner image of a toner;

a sensor configured to detect a mark formed as the toner image by the forming section;

a storage; and a controller, wherein the controller is configured to perform:

forming a first mark by applying a developing bias voltage of a first test bias voltage value to the developing portion and developing an electrostatic latent image on the image holding member;

forming a second mark by applying a developing bias voltage of a second test bias voltage value to the developing portion and developing the electrostatic latent image on the image holding member;

obtaining a density of the first mark and a density of the second mark based on a signal from the sensor;

obtaining a slope based on both an amount of change in the first test bias voltage value and the second test bias voltage value and an amount of change in the density of the first mark and the density of the second mark;

determining a target bias voltage value corresponding to a target density based on the slope, and at least one of a first set and a second set, wherein the first set includes the first test bias voltage value and the density of the first mark, the second set includes the second test bias voltage value and the density of the second mark; and storing the target bias voltage value in the storage, wherein the controller is configured to perform determining based on the slope and a set, wherein the set is the first set when the first density closer to the target density, the set is the second set when the second density is closer to the target density.

11. An image forming apparatus comprising:

a forming section having an image holding member and an developing portion, and configured to apply a developing bias voltage to the developing portion to develop an electrostatic latent image on the image holding member so as to form a toner image of a toner;

a sensor configured to detect a mark formed as the toner image by the forming section;

a storage; and a controller, wherein the controller is configured to perform:

forming a first mark by applying a developing bias voltage of a first test bias voltage value to the developing portion and developing an electrostatic latent image on the image holding member;

forming a second mark by applying a developing bias voltage of a second test bias voltage value to the developing portion and developing the electrostatic latent image on the image holding member;

obtaining a density of the first mark and a density of the second mark based on a signal from the sensor;

obtaining a slope based on both an amount of change in the first test bias voltage value and the second test bias voltage value and an amount of change in the density of the first mark and the density of the second mark;

determining a target bias voltage value corresponding to a target density based on the slope, and at least one of a first set and a second set, wherein the first set includes the first test bias voltage value and the density of the first mark, the second set includes the second test bias voltage value and the density of the second mark; and storing the target bias voltage value in the storage, wherein the controller is configured to perform judging whether or not the slopes are within a predetermined range; and wherein determining the target bias voltage value based on the slopes determined to be within the predetermined range in response to the judgment in which the slope is within the predetermined range.

12. The image forming apparatus according to claim 10, wherein the controller is configured to perform forming the first mark and the second mark, wherein the first mark and second mark are at mutually different positions, respectively, on the image holding member.

13. The image forming apparatus according to claim 10, wherein the controller is configured to perform:

presuming highness or lowness of the densities of the first and second of the image forming apparatus since a point of time when the forming of the first and second marks has been previously executed; and shifting of at least a minimum test bias voltage value among the first and second test bias voltage values to a side of lower voltage than that at the point of time when the forming of the first and second marks has been previously executed or before the point of time, in response to the presumption that the densities of the first and second marks are high with respect the reference bias voltage value, and shifting of at least a maximum test bias voltage value among the first and second test bias voltage values to a side of higher voltage than that at the point of time when the forming of the first and second marks has been previously executed or before the point of time, in response to the presumption that the densities of the first and second marks are low with respect the reference bias voltage value.

14. The image forming apparatus cording to claim 10, wherein the controller is configured to perform forming both of the first and second marks.

15. The image forming apparatus according to claim 10, wherein the forming section has a plurality of pieces of the developing portion; and wherein the controller is configured to perform, individually for each of the plurality of developing portions, forming the first and second marks, obtaining the density of the first mark and the density of the second mark, determining the target bias voltage value, and storing the target bias voltage value.

16. The image forming apparatus according to claim 15, wherein in the forming of the first and second marks, the controller makes a bias voltage difference between the first and second test bias voltage values be different with respect to at least two developing portions among the plurality of developing portions.

17. The image forming apparatus according to claim 10, wherein the controller is configured to perform judging whether or not a density condition is satisfied, the density condition including that the target density is included in a density range between the densities of the first and second marks; and wherein, under a condition that the controller judges that the density condition is satisfied, the controller determines the target bias voltage value based on the slopes in the determination of the target bias voltage value.

18. The image forming apparatus according to claim 10, further comprising a receiving portion;

wherein the controller is configured to perform:

judging whether or not an execution condition based on a change in a state of the image forming apparatus since a point of time when the forming of the first and second marks has been previously executed, wherein the execution condition is that the image forming apparatus executes the forming of the first and second marks is satisfied;

judging whether or not the receiving portion receives an execution instruction in response to the judgment in which the execution condition is not satisfied; and decreasing of a bias voltage difference between the first and second test bias voltage values to a smaller value in response to judge the receiving portion does not receive an execution instruction, wherein the smaller value is smaller than the bias voltage difference that at the point of time when the forming of the first and second marks has been previously executed or before the point of time.

19. The image forming apparatus according to claim 11, wherein the forming section has a plurality of pieces of the developing portion; and wherein the controller is configured to perform, individually for each of the plurality of developing portions, forming the first and second marks, obtaining the density of the first mark and the density of the second mark, determining the target bias voltage value, and storing the target bias voltage value.

20. The image forming apparatus according to claim 11, wherein the controller is configured to perform judging whether or not a density condition is satisfied, the density condition including that the target density is included in a density range between the densities of the first and second marks; and wherein, under a condition that the controller judges that the density condition is satisfied, the controller determines the target bias voltage value based on the slopes in the determination of the target bias voltage value.

21. The image forming apparatus according to claim 11, wherein the controller is configured to perform:

presuming highness or lowness of the densities of the first and second of the image forming apparatus since a point of time when the forming of the first and second marks has been previously executed; and shifting of at least a minimum test bias voltage value among the first and second test bias voltage values to a side of lower voltage than that at the point of time when the forming of the first and second marks has been previously executed or before the point of time, in response to the presumption that the densities of the first and second marks are high with respect the reference bias voltage value, and shifting of at least a maximum test bias voltage value among the first and second test bias voltage values to a side of higher voltage than that at the point of time when the forming of the first and second marks has been previously executed or before the point of time, in response to the presumption that the densities of the first and second marks are low with respect the reference bias voltage value.

* * * * *